United States Patent [19]

Senolt et al.

[11] 4,001,091

[45] Jan. 4, 1977

[54] ASPHALT BLOWING VESSEL

[75] Inventors: Hans Senolt; Heinrich Tomaschko; Georg Palvik, all of Vienna, Austria

[73] Assignee: Osterreichische Mineralolverwaltung AG, Vienna, Austria

[22] Filed: Dec. 16, 1974

[21] Appl. No.: 532,823

Related U.S. Application Data

[60] Continuation of Ser. No. 306,820, Nov. 15, 1972, abandoned, which is a division of Ser. No. 843,970, July 23, 1969, Pat. No. 3,773,649.

[30] Foreign Application Priority Data

July 25, 1968 Austria ..... 7210/68

[52] U.S. Cl. ..... 196/46; 196/126; 196/127; 208/6

[51] Int. Cl.[2] ..... C10C 1/20; C10G 17/00

[58] Field of Search ..... 196/46, 123, 125, 126, 196/127; 208/6, 4, 100, 108

[56] References Cited

UNITED STATES PATENTS

| | | | |
|---|---|---|---|
| 1,766,446 | 6/1930 | Miller | 196/127 |
| 1,988,766 | 1/1935 | Aldridge | 196/125 |
| 2,738,313 | 3/1956 | Miller | 208/6 |
| 3,531,375 | 9/1970 | Cheracci | 208/6 |

*Primary Examiner*—Norman Yudkoff
*Assistant Examiner*—Martin G. Mullen
*Attorney, Agent, or Firm*—Holman & Stern

[57] ABSTRACT

The undesirable and damaging reaction heat occurring during the blowing of asphalt is avoided by injecting water into the air inlet pipes of the reactor vessel heated by the hot asphalt surrounding them. During this, the superheated steam produced without expenditure is passed through the liquid asphalt, causing the removal of low molecular hydrocarbons formed during the blowing or stripping.

3 Claims, 1 Drawing Figure

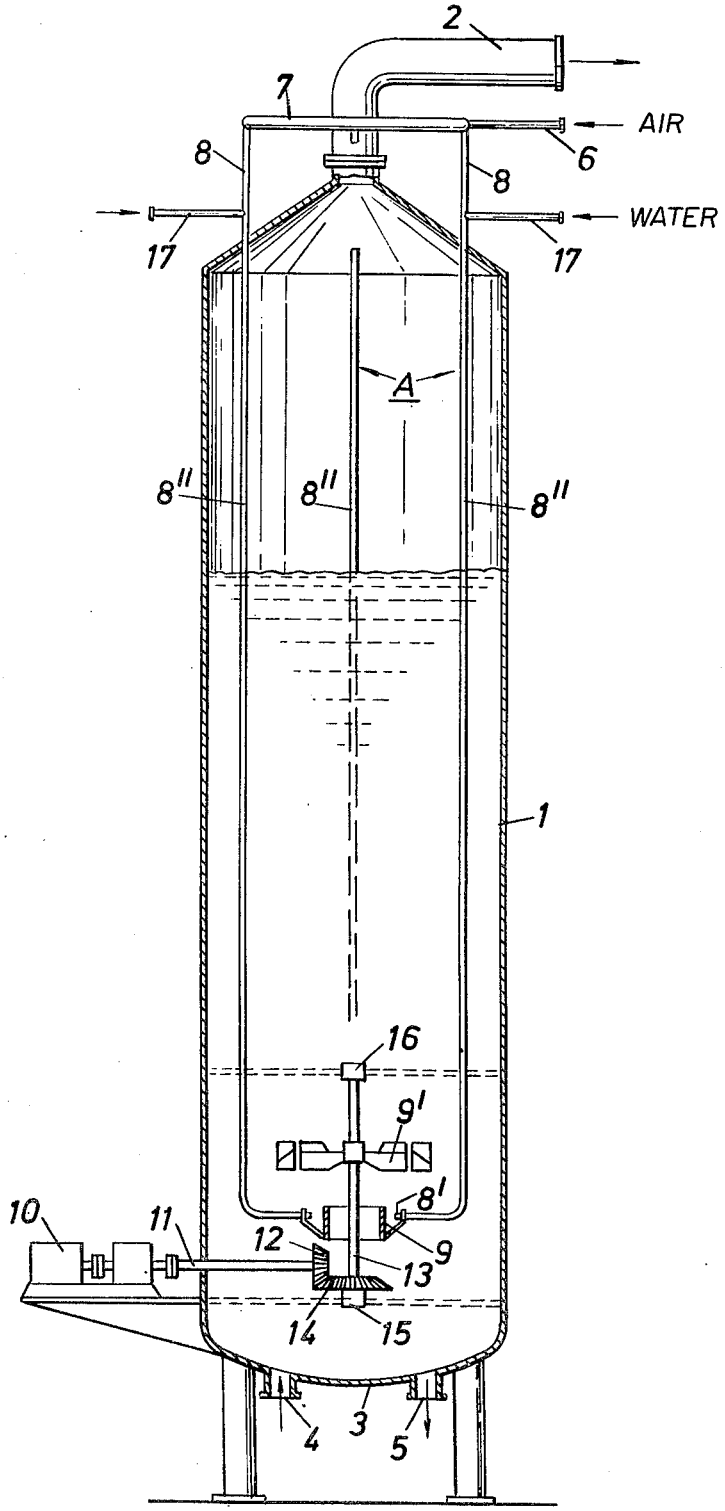
2
7
AIR
6
8
8
WATER
17
17
A
8''
8''
8''
1
16
9'
8'
10
11
12
9
13
14
15
4
3
5

ASPHALT BLOWING VESSEL

This is a continuation of application Ser. No. 306,820 filed Nov. 15, 1972 now abandoned which in turn is a Rule 60 Divisional of Ser. No. 843,970 filed July 23, 1969 now issued as U.S. Pat. No. 3,773,649.

FIELD OF THE INVENTION

This invention relates to bitumen blowing rock ground of the invention is a very viscous liquid, consisting essentially of hydrocarbons bitumen, and is soluble in carbon disulphide. It is substantially nonvolatile and softens gradually when heated. It is black or brown in colour and possesses waterproofing and adhesive properties. It is obtained principally by refinery processes from petroleum oil, and is also found as a natural deposit or, in association with mineral matter as a component of naturally occuring asphalt.

The known bitumen blowing process is used to produce mineral oil bitumen of a desired hardness from soft mineral oil distillation residues, which are termed soft bitumen. The process essentially consists of blowing air into soft bitumen placed in a blast reactor vessel so that the bitumen becomes finely divided. The most favourable reaction temperature depends on the composition of the mineral oil distillation residue introduced, but is generally about 250° C. But since the blowing process is exothermic, the heat of reaction causes a rapid rise in the temperature of the material being treated so that the desired reaction temperature is exceeded which has a considerable detrimental effect on the quality of the end product. Too high temperatures lead in particular to the formation of carbonaceous material and carboids which are undesirable. It is therefore necessary to remove the heat of reaction from the bitumen.

The invention relates to a bitumen blowing apparatus in which bitumen is cooled during a blowing process by injecting liquid water into an air stream and passing the air stream containing water through the bitumen. In the known processes of this kind suitable cooling of the bitumen can be achieved, but there is the disadvantage that, as a result of the high flow velocity in the air stream, which is generally 40–60 m/sec, the water introduced into the air stream may be carried along by the air stream in liquid form to the bitumen and when it comes into contact with the hot bitumen explosive evaporation of the water may occur and as this leads to irregularities in the treatment of the bitumen and sometimes the contents of the reactor foam over. This is particularly liable to happen if accumulations of water form at particular points in the blast air line and are then suddenly blown into the hot reaction material.

SUMMARY OF THE INVENTION

According to the invention these disadvantages are avoided or effectively reduced by evaporating the water in the air inlet tube which is surrounded by the asphalt before it is passed through the bitumen by extracting heat from the bitumen so that the water reaches the bitumen in vapour form. In this manner, the cooling water reaches the asphalt together with the blowing air only in the form of water vapor. Thus there is no direct contact between hot bitumen and liquid water so that regular treatment of the bitumen can be achieved since the reaction temperature can be maintained constant at a desired value and without any significant variations, and foaming over of the bitumen is inhibited. The cooling is extremely efficient since at no point in the blowing air line is the temperature significantly below the reaction temperature so that the mobility of the bitumen is maintained and so consequently is heat transfer by natural convection. At the same time the cooling is extremely economical as not only the thermal capacity of the water but the latent heat of evaporation, which is approximately seven times greater than the thermal capacity of the water, is used for the cooling. There is no danger of petrification of the cooling surfaces since the inner surfaces of the blowing air line are generally moistened with bitumen. It has been found to be particularly advantageous to reduce the flow velocity of the air stream to 5 to 8 m/sec before the water is introduced. This velocity ensures complete evaporation of the water introduced into the air stream before it reaches the bitumen and consequently the extraction of heat from the bitumen even if the length of the blowing air line in the blast reactor is relatively small.

By means of the injecting tube formed in the air stream and fed into the bitumen the low-molecular hydrocarbons in the soft bitumen can be driven off so that again in this respect the process according to the invention is particularly advantageous. As is known, in the course of the bitumen blowing process not only the desired high-molecular polymerisation products, such as asphaltenes, are formed, but also reaction by-products such as $H_2O$, $CO_2$ and low-molecular hydrocarbons (blowing distillate) which are only partially able to escape with the exhaust air, a considerable part remaining in the bitumen which results both in slowing down the blowing process and an improverishment of the quality of the end product. Amongst other things, these reaction by-products lower the flash point and increase the "loss on heating" of the end product. The amount of superheated steam needed to drive off these undesired reaction by-products, that is for so-called "stripping" of the bitumen is about 60 kg per ton of bitumen. In the case of the process according to the invention this requirement may be entirely covered by the cooling water evaporated in the air injecting tube and passed as steam through the bitumen so that it is unnecessary to provide additional steam to remove the byproducts. The superheated injecting tube formed in the air stream thus takes over the function of stripping, the latter being carried out particularly intensively since, for example, in the case of a blowing vessel with a capacity of 40 tons up to 120 kg of water per ton of bitumen can be introduced into the blowing air line. Thus, by eliminating the otherwise necessary additional stripping steam, besides especially effective cooling there is also a considerable reduction in the low boiling oil fractions of the reaction material, which means concentration of the asphaltenes. Tests on the "flash point" and "loss on heating" in the case of bitumen blown according to the invention give good results.

Furthermore the steam formed in the blowing air line and then passed through the bitumen reduces the oxygen content of the exhaust air i.e. the air which has passed through the bitumen. When there is a high oxygen content of the exhaust air, the hydrocarbon vapours and mist in the exhaust air undergo reactions which can cause undesirable coking of exhaust air system and/or to combustion and explosions. To eliminate or reduce these dangers, it has been the practice to blow extra steam into the exhaust air space above the bitumen. This steam is called blanketing steam. This gives rise to additional costs and furthermore, in the case of intermittent operation, due to the formation of condensation can lead to the blowing member contents foaming over. In the process according to the invention the production and introduction of this additional blanketing steam is unnecessary. This has the advantage that the steam which has risen through the bitumen and been further heated by it is especially uniformly distributed in the exhaust air space since it escapes over the whole surface of the reaction material and thus there is a uniform reduction in the residual oxygen content in all regions of the exhaust air space. Thus the water fed to the blowing vessel and evaporated in the blowing air line is used not only for cooling, but in addition as stripper steam and also as blanketing steam.

The bitumen blowing vessel according to the invention for carrying out the process of the invention comprises a blowing vessel, a blowing air line having a water inlet, the blowing air line at, and downstream of the water inlet being of sufficient dimensions for all the water introduced into it to be evaporated. These dimensions can be determined empirically or by calculation without any difficulty for a particular case. It is of advantage if the air injecting line supplied with water has a greater flow cross-section than the part upstream of this so that the flow velocity of the air entraining the water is reduced from 40 to 60 m/sec to 5 to 8 m/sec. To produce the required increase in the flow cross-section and also the cooling surfaces of the part of the blowing air line fed with water this part can take the form of several tubes in parallel, the total internal cross-section of which is greater than that of the blowing air line. The tubes can pass from an air distributing ring or manifold arranged above the blowing vessel through the blowing vessel to a gas distributor mounted in the region of the base of the vessel. Each tube may be provided with a separate water inlet.

DESCRIPTION OF THE DRAWINGS

The invention will be described in more detail with reference to the accompanying drawing which shows a longitudinal section through a blast reactor according to the invention.

DESCRIPTION OF A PREFERRED EMBODIMENT

The cylindrical blowing vessel is denoted by 1, and an exhaust air line leaving the top of the vessel is denoted by 2. In the vessel base 3 there is an input aperture 4 through which a material to be treated, that is a soft mineral oil distillation residue for conversion into a mineral oil bitumen of a desired hardness can be pumped into the reactor The treated bitumen can be removed through an outlet 5 in the vessel base 3. A blowing air line 6 communicates with an air distributor ring or manifold 7. Landing from the distributor ring 7 are four parallel tubes 8 forming a blowing air line A. Only three of these tubes 8 are shown in the injecting. The tubes 8 pass through the upper wall of one being partially broken away and down through the vessel to a gas distributor 9, 9' in the base of the vessel. The distributor 9, 9' consists of a cylindrical part 9 and a disperser turbine 9'. Mouths 8' of the tubes 8 are directed towards the wall of the part 9. The disperser turbine 9' is driven by a motor 10. Shaft 11 of the motor 10 carries a bevel gear 12 which meshes with a bevel gear 14 on turbine shaft 13. 15 shows the lower position of the turbine shaft 13 and 16 the upper position.

Each tube 8 is provided with a water feed pipe 17 to which the necessary quantity of water to keep the temperature constant is supplied by a dosing pump. The parts 8'' of the tubes 8 to be fed with water have a total flow cross-section which is greater than that of the blowing air line 6. Thus the flow velocity of the blowing air in the parts 8'' is less than that in the blowing air line 6. The cooling surfaces of the part 8'' of the blowing air line A fed with water is considerably increased by distributing the total flow cross-section amongst the tubes 8. In the blowing vessel the blowing air injecting line formed by these tubes if of dimensions sufficient to evaporate all the water fed into them, these dimensions being determined empirically or by calculation taking into account the respective given or desired behaviour.

Air is fed through the blowing air line 6 to the blowing vessel at a speed of about 40–60 m/sec. This air is distributed by the air distributor or manifold ring 7 to the four tubes 8 forming the blowing air line A, and in which the flow velocity is reduced to about 5–8 m/sec. Water is sprayed into the tubes 8 through the water lines 17, is entrained by the air and is completely evaporated within the blast air line surrounded by the hot bitumen in the blowing vessel. Due to the large heat of evaporation, the corresponding heat removed from the bitumen is considerable so that with a relatively small amount of water there is intensive cooling of the bitumen to control the desired reaction temperature. The superheated steam entrained by the air blast escapes into the bitumen through the tube mouths 8' together with the air blast, is deflected by the cylindrical part 9 to the disperser turbine 9' and, like the air, is dispersed in fine bubbles which rise through the bitumen. The steam is thus still further superheated by the hot bitumen and thus achieves especially intensive stripping, that is practically complete blowing off of undesired reaction by-products, in particular low-molecular hydrocarbons, which would detrimentally affect the quality of the end product and in addition slow down the blowing process. The foaming over of the blowing is inhibited since water only enters the blowing vessel contents in the form of steam. The steam then very uniformly distributed over the surface of the bitumen takes over the function of the previously used blanketing steam, that is the steam reduces the percentage residual oxygen content of the waste gases collecting in the waste air space to be removed through the air discharge pipe 2. Since the superheated steam cannot contain any water in liquid form, foaming over the blowing vessel contents is inhibited by the saturated blowing steam.

The water fed to the tubes 8 is thus used not only for especially efficient cooling of the blowing vessel contents, but also for stripping and in addition for the necessary dilution of the waste air.

We claim:

1. In a system for blowing a molten bitumen residue, comprising: a blowing vessel including means for introducing a bitumen distillation residue and removing a converted residue and maintaining a level of the residue being treated in the vessel with a space thereabove, said vessel including an exhaust line at an upper portion thereof for communicating with the space above the level of molten residue maintained in the vessel, the improvement including air-line means for introducing air into said vessel below the surface of the residue, said air-line means extending into the vessel through the space above the residue in the vessel and being immersed therein over a substantial portion thereof in the molten residue in heat-exchanging relationship, said air-line means opening into the vessel for discharging air substantially below the surface of the molten residue maintained therein; water-inlet means connected to the air-line means above the residue level substantially upstream of said air-line means opening introducing water traversing the air-line means with wet air and in a heat-exchanging relationship along said air-inlet means within the molten residue so that the water is evaporated and combines with the air in said air-line means before discharge beneath the surface of the molten bitumen residue, the sizes of the air-line means and water-inlet means and heat-exchanging portions being proportioned so that evaporation of the water in said air-line means is substantially complete before discharge beneath the surface of the molten bitumen residue so that the temperature of the distillation residue is controlled, a masking blanket of steam forms over the surface of the bitumen residue contained within the vessel and reaction and foaming at the surface of the bitumen residue is minimized within the vessel, while stripping off of undesired reaction by-products is enhanced and waste product vapors are removed from the vessel through said exhaust line and are diluted, said air-line means downstream of said water-inlet means comprising a plurality of enlongated tubes depending into said vessel, said tubes being impervious and opening at their distal ends, said vessel being substantially elongated and extending vertically, said air and steam distributor means including an annular ring element disposed axially of the vessel, the tubes having their open ends directed toward the outer surface of the annular ring for dispersing the mixture of steam and air beneath the surface of the molten residue.

2. In the system as claimed in claim 1, in which the heat-exchange portions of said air-line means have a total flow cross-section greater than upstream portions of said airline means.

3. In the system as claimed in claim 1, including an air-manifold exteriorly of said vessel and communicating with said elongated tubes, the open ends of said elongated tubes terminating in air and steam distributor means adjacent a lower portion of said vessel and beneath the surface of the bitumen residue being treated.

* * * * *